United States Patent [19]

Hirosaki et al.

[11] Patent Number: 4,671,844

[45] Date of Patent: Jun. 9, 1987

[54] LABELING APPARATUS

[75] Inventors: Yukihiro Hirosaki; Seiji Koike; Motonobu Hamada; Takahiko Ohhata, all of Shizuoka; Yasuo Inoue, Kawasaki; Haruyuki Karibe, Atsugi; Hideki Hama, Machida, all of Japan

[73] Assignees: Tokyo Electric Co., Ltd.; Sony Corporation, both of Tokyo, Japan

[21] Appl. No.: 849,822

[22] Filed: Apr. 9, 1986

[30] Foreign Application Priority Data

Apr. 15, 1985 [JP] Japan ..... 60-79669

[51] Int. Cl.[4] ..... B65C 9/04; B65C 1/02; B44C 1/00; B31F 5/00

[52] U.S. Cl. ..... 156/542; 156/384; 156/556; 156/DIG. 2; 156/DIG. 27

[58] Field of Search ..... 156/541, 540, 384, 361, 156/475, 556, 542, 457, 486, 489, 491, 584, DIG. 2, DIG. 26, DIG. 27, DIG. 39, DIG. 48, DIG. 10, DIG. 12, DIG. 13, DIG. 33, DIG. 47; 400/120; 101/33, DIG. 3

[56] References Cited

U.S. PATENT DOCUMENTS

| | | | |
|---|---|---|---|
| 1,176,854 | 3/1916 | Ratner | 156/DIG. 2 |
| 1,253,995 | 1/1918 | Stake | 156/491 |
| 1,304,373 | 5/1919 | Reiners | 156/491 |
| 2,619,247 | 11/1952 | Gauburt | 156/DIG. 2 |
| 2,724,329 | 11/1955 | Lucas | 156/DIG. 10 |
| 3,888,724 | 6/1975 | Spannkuebel et al. | 156/DIG. 12 |
| 3,989,574 | 11/1976 | Evans | 156/566 |
| 4,233,105 | 11/1980 | Albinger | 156/566 |
| 4,601,771 | 7/1986 | Wesley | 156/361 |

*Primary Examiner*—Donald E. Czaja
*Assistant Examiner*—Louis Falasco
*Attorney, Agent, or Firm*—Oblon, Fisher, Spivak, McClelland & Maier

[57] ABSTRACT

A labeling apparatus holds an article to which a label is to be stuck, on a holder and then moves the holder carrying the article from a home position via a waiting position and a labeling position back to the home position. In a label peeling and issuing section, the article is moved up toward a label being issued in the label peeling and issuing section and is brought into contact with the label so that the label is peeled from the supporting strip and stuck to the article as the holder holding the article is moved toward the home position along guide paths. Reverse movement preventing plates prevent the reverse movement of the holder as the holder is moved along the guide paths. With the labeling apparatus the label can applied to the article simply and automatically without requiring a manual labeling operation.

15 Claims, 5 Drawing Figures

LABELING APPARATUS

FIELD OF THE INVENTION AND RELATED ART STATEMENT

FIG. 5 illustrates a conventional label printer 1 and a conventional labeling apparatus 3 combined with the label printer 1. A label 2 printed with necessary information by the label printer 1 is peeled from the supporting sheet and is issued to the labeling apparatus 3. The labeling apparatus 3 holds the label 2 by suction with a label sucker 5 held on a moveable arm 4, then turns the moveable arm 4 to bring the label 2 above an article 6, and then presses the label 2 on the surface of the article 6 to stick the label 2 adhesively to the article 6.

This conventional labeling apparatus has difficulty in sticking the label 2 always at a fixed position on the articles 6 due to cumulative positional variations in issuing the label 2 to the labeling apparatus 3, in transferring the label 2 to the label sucker 5, in the height of the surface of the article 6 at a labeling position and in carrying the label 2 by the label sucker 5 to the labeling position.

OBJECT AND SUMMARY OF THE INVENTION

It is a first object of the present invention to bring a holder carrying an article correctly to a labeling position to stick a label correctly to the article.

It is a second object of the present invention to enable stable labeling operation.

It is a third object of the present invention to simplify and facilitate labeling operation.

The above and other objects, features and advantages of the present invention will become more apparent from the description of a preferred embodiment thereof tanken in conjunction with the accompanying drawings.

According to the present invention, a labeling apparatus comprises a label peeling and issuing device for peeling and issuing a label printed with information by a label printer from the supporting sheet, a shiftable holder for holding an article to which a label is to be sticked, disposed near the label peeling and issuing device, a holder guiding devices for guiding the holder from a home position where the holder is set apart from the label peeling and issuing device for receiving an article therein, via a waiting position obliquely below the label peeling and issuing device to a labeling position where a label issured by the label peeling and issuing device is sticked to the article held on the holder, and reverse movement preventing devices for restricting the movement of the holder so that the holder is moved only in one direction along guide paths from the home position via the waiting position and the labeling position back to the home position.

Basically, the labeling apparatus according to the present invention moves an article relative to a label peeled from the supporting sheet and issued by the label peeling and issuing device instead of moving a label relative to an article as in the conventional labeling apparatus. Accordingly, the positional variation of the article relative to the laveling position is reduced, and hence satisfactory labeling operation is achieved. Since an article is held on the holder and the holder is moved only in one direction along holder guiding paths provided with reverse movement preventing devices, respectively, to the labeling position opposite the label peeling and issuing device for the successive labeling operation, the label is sticked accurately to the article at a correct position without the possibility of faulty labeling. Moreover, the article can be set on the holder easily when the holder is located at the home position.

DETAILED DESCRIPTION OF THE PREFERRED EMBODIMENT

Figure 1:
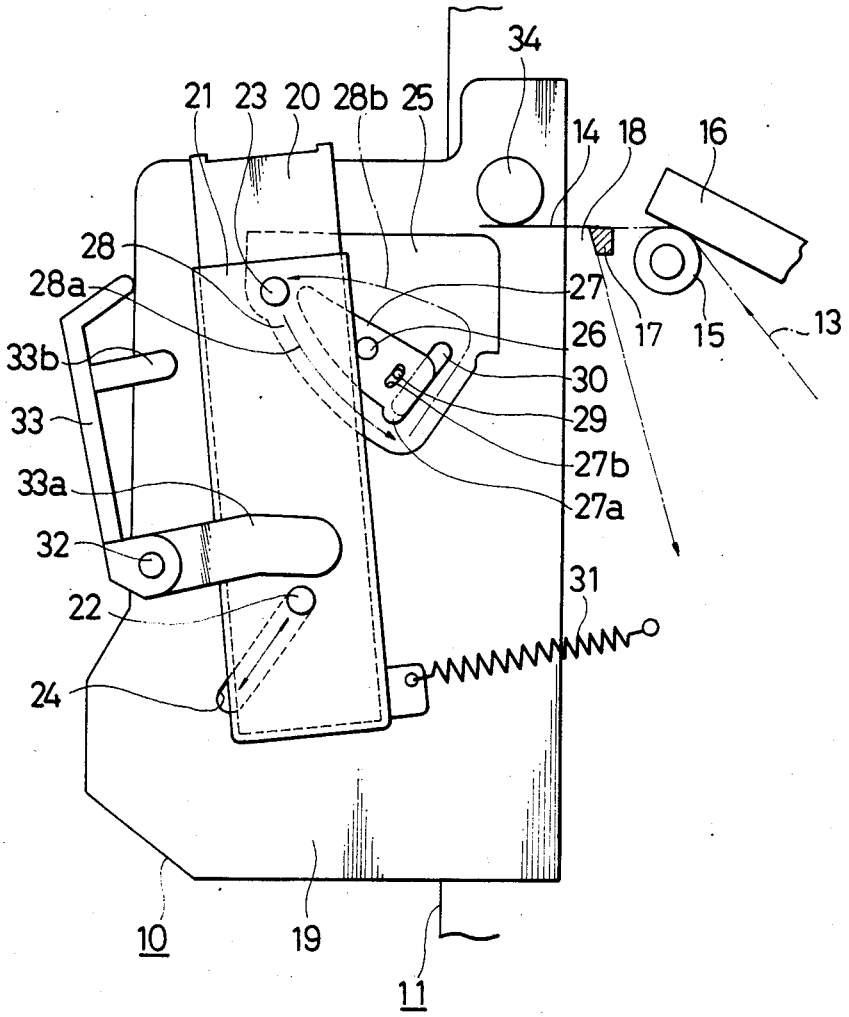
FIG. 1 is a sectional side elevation of a labeling apparatus, in a preferred embodiment, according to the present invention, in which the holder is at the home position.

A preferred embodiment of the present invention will be described hereinafter with reference to FIGS. 1 to 4, as applied to an automatic video cassette delivering apparatus for efficiently sticking a label indicating the contents of a video cassette to the video cassette at a broadcasting station. Referring to FIG. 4, a labeling apparatus 10 is incorporated into the front panel (control panel) of a label printer 11 to constitute a label printing and labeling apparatus. As illustrated in FIG. 1, the label printer 11 prints appropriate information by a thermal head 16, namely, a printing head, on rectangular labels 14 sticked in succession to a continuous elongate supporting strip 13 as the labels 14 are carried by a platen roller 15 and issues the inscribed labels 14 by peeling the inscribed labels 14 from the supporting strip 13 with a label peeling plate 17. The label peeling plate 17 is disposed in a label peeling and issuing section 18.

The labeling apparatus 10 is formed in an open structure having opposite side plates 19 and an open room formed between the opposite side plates 19. A holder 21 for removeably holding an article 20 to which the label 14 is to be sticked, for example, a rectangular video cassette, is disposed in the open room. The holder 21 is formed in the shape of a box and is provided on each side wall thereof with an upper pin 22 and a lower pin 23 spaced apart from each other. Linear guide grooves 24 are formed to guide the lower pins 22 for linear movement in the side plates 19, respectively. Substantially triangular recesses 25 are formed in the inner surfaces of the side plates 19 in an area in which the upper pins 22 move, respectively. A triangular reverse movement preventing plate 27 is pivoted on a pivot 26 in the central portion of the recess 25. A substantially triangular guide path 28 for guiding the upper pin 23 around the reverse movement preventing plate 27 in the recess 25 is formed around the reverse movement preventing plate 27. A protrusion **27*a* is formed at a position on the reverse movement preventing plate 27. The reverse movement preventing plate 27 is urged clockwise with a weak spring, not shown. The clockwise movement of the reverse movement preventing plate 27 is limited with a stopper pin 29 engaging a slot 27*b*** formed in the reverse movement preventing plate 27. A guide ridge 30 is formed in part of the recess 25. The linear guide groove 24 is inclined so as to extend toward the label peeling and issuing section 18. A portion of the guide path 28 extending along the guide ridge 30 is a linear path extending toward the label peeling and issuing section 18. An extension spring 31 is connected to the lower end of the holder 21 for the semiautomatic movement of the holder 21.

A swingable setting lever 33 is provided in front of the holder 21 so as to be swingable on a pivot 32. The setting lever 33 is provided at the lower end thereof with pressing members 33*a* for depressing the lower pins 22 and in the intermediate part thereof with pushing members 33*b* which contact the front surface of the holder 21 to facilitate the tilting motion of the holder 21. A label pressing roller 34 is disposed vertically moveably in the upper part of the label peeling and issuing section 18.

Figure 2:
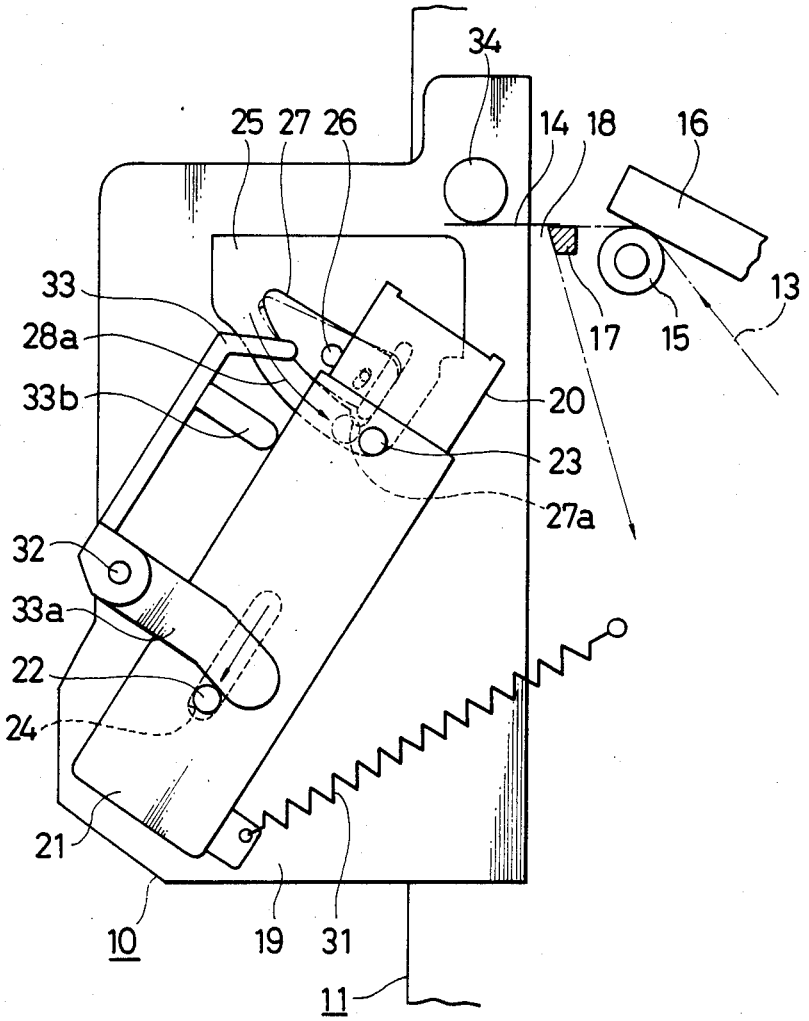
FIG. 2 is a sectional side elevation of the labeling apparatus of FIG. 1, in which the holder is at the waiting position.
Figure 3:
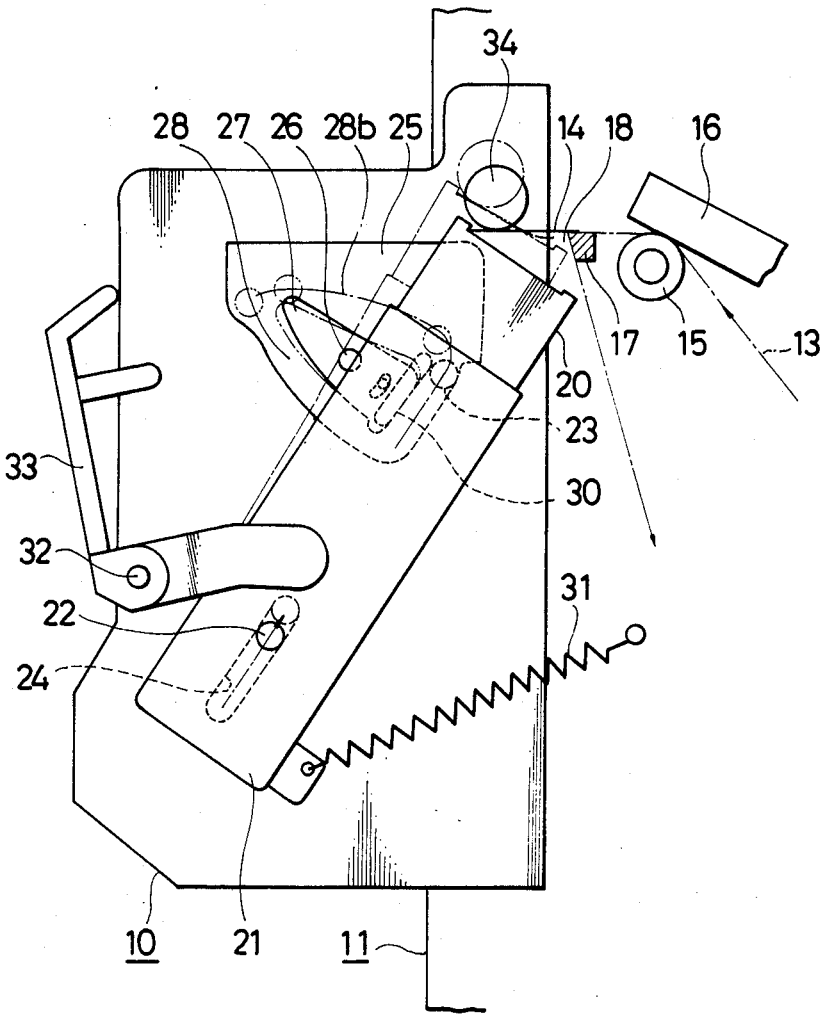
FIG. 3 is a sectional side elevation of the labeling apparatus of FIG. 1, in which the holder is at the labeling position.
Figure 4:
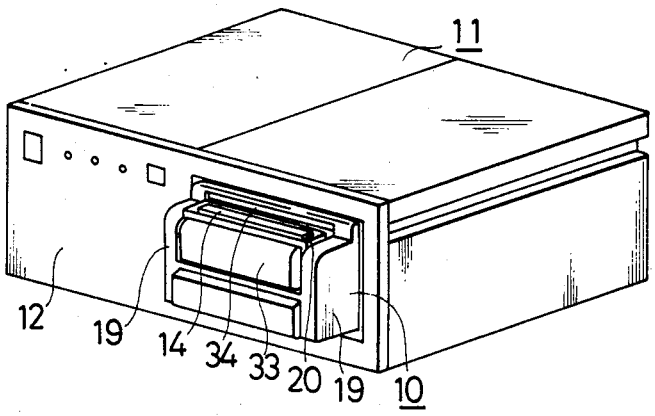
FIG. 4 is a perspective view showing the general appearance of a label printer incorporating the labeling apparatus according to the present invention.
Figure 5:
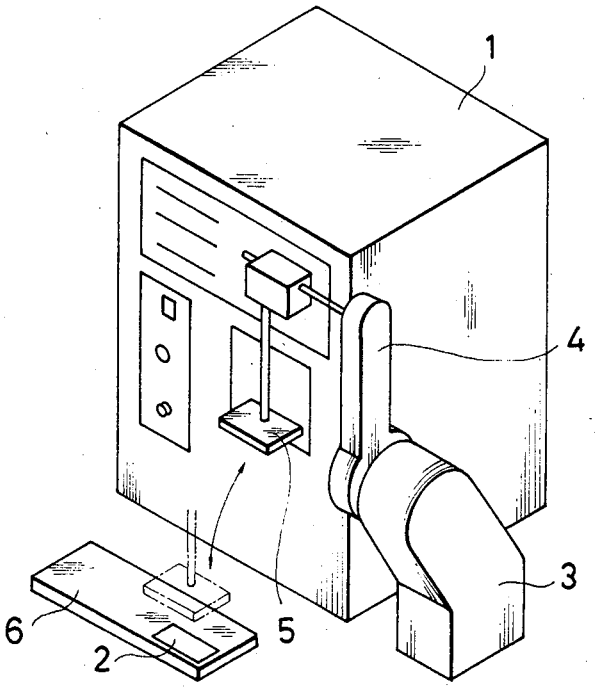
FIG. 5 (PRIOR ART)
FIG. 5 is a perspective view showing a combination of a conventional label printer and a conventional labeling apparatus.

In FIGS. 1, 2 and 3, the holder 21 is located at the home position, at the waiting position and at the labeling position, respectively. When the holder 21 is located at the home position, the extension spring 31 contracts to the minimum working length to tilt the holder 21 away from the label peeling and issuing section 18 so that the article 20 to which the label 14 is to be sticked can be easily put in or taken out from the holder 21. After the article 20 has been set in the holder 21, the setting lever 33 is pushed namually to move the holder 21 manually to the waiting position as shown in FIG. 2. When the setting lever 33 is pushed manually, the lower pins attached to the lower part of the holder 21 are depressed by the pressing members 33*a*, so that the lower pins 22 move downward along the guide grooves 24. Since the lower pins 22 are depressed for linear movement with the swingable setting lever 33, the holder 21 is moved smoothly to the waiting position by a small force, which facilitate article setting operation. It is possible to move the holder 21 to the waiting position only with the pushing members 33*b*. However, without the function of the pressing members 33*a*, it is impossible to move the lower pins 22 smoothly along the corresponding guide grooves 24, since the pushing members 33*b* are unable to apply force to the lower pins 22 in the direction of movement of the same along the corresponding guide grooves 24. On the other hand, the upper pins 23 of the holder 21 move along sections 28*a* of the corresponding guide paths 28 downward as indicated by an arrow in FIG. 1. At the start of the downward movement of the upper pins 23, the reverse movement preventing plates 27 are urged clockwise with springs, not shown, and hence the upper pins 23 are unable to enter sections 28*b* of the guide paths 28 over the reverse movement preventing plates 27. Thus, the entrance of the upper pins 23 into the sections 28*b*, namely, return path sections, of the guide paths 28 is prevented. Consequently, the upper pins 23 move smoothly downward along the sections 28*a*, respectively. Immediately before arriving at a position corresponding to the waiting position of the holder 21, each upper pin 23 comes into abutment with the protrusion 27*a* of the reverse movement preventing plate 27 to turn the reverse movement preventing plate 27 slightly counterclockwise, and then the upper pin 23 reaches a position corresponding to the waiting position of the holder 21 as illustrated in FIG. 2. Upon the arrival of the holder 21 at the waiting position, the reverse movement preventing plates 27 are turned counterclockwise by the springs to the original position, so that the reverse movement of the upper pins 23 along the sections 28*a* of the guide paths 28 is prevented. When the holder 21 is thus located at the waiting position, the extension spring 31 is extended to its maximum working length, and thereby energy to move the holder 21 from the waiting position to the labeling position is stored in the extension spring 31.

After the holder 21 (the article 20) has been manually moved to the waiting position through the manual operation of the setting lever 33, the setting lever 33 is released free. Then, automatic labeling operation is started. Since the reverse movement of each upper pin 23 is prevented by the protrusion 27*a* of the reverse movement preventing plate 27, the holder 21 carrying the article 20 is moved toward the labeling position by the energy stored in the extension spring 31. While the movement of the holder 21 toward the labeling position, each upper pin 23 is guided by the guide ridge 30 toward the label peeling and issuing section 18, while each lower pin 22 moves along the linear guide groove 24. Thus, the upper end of the article 20 held on the holder 21 is moved toward the label 14 being peeled from the supporting strip 13 and being issured in the label peeling and issuing section 18 and is brought below the label 14. Then the upper end of the article 20 comes into contact with the label pressing roller 34 with the label 14 therebetween. Since the underside of the label 14 is coated with an adhesive, the label 14 is sticked to the upper end of the article 20 as the article 20 (the holder 21) is moved toward the front of the labeling apparatus, namely, toward the home position, raising the label pressing roller 34 and the label 14. While the article 20 is moved gradually toward the front of the labeling apparatus raising the label 14, each upper pin 23 moves along the guide ridge 30 and, after arriving at the upper end of the guide ridge 30, the upper pin 23 moves along an arc of a circle having its center on the center axis of the lower pin 22 located at the upper end position, namely, at the upper end of the linear guide groove 24, toward a position corresponding to the home position of the holder 21. Immediately before arriving at the position corresponding to the home position of the holder 21, the upper pin 23 depresses the upper end of the reverse movement preventing plate 27 slightly. Upon the arrival of the holder 21 at the home position, the reverse movement preventing plate 27 is turned to the original position by the spring.

Thus, according to the present invention, the article 20 is moved to the label 14 being issued in the label peeling and issuing section 18, where the label 14 is sticked to the article 20. Accordingly, the position of the label 14 on the article 20 is less variable as compared with the position of the label sticked to the article by the conventional labeling apparatus which moves the label to the article. This embodiment, in particular, holds the article 20 on the holder 21 and moves the holder 21 surely from the waiting position to the labeling position only in a fixed direction by guiding the holder straight guide grooves 24, the guide paths 28 and the reverse movement preventing plates 27. Therefore, the holder 21 (the article 20) is moved surely and the article 20 is located accurately at the lableing position. In the label peeling and issuing section 18, the rear end of the label 14 is still on the supporting strip 13 when the upper end of the article has come into contact with the front end of the label 14. The article 20 pushes up the label 14 as the holder 21, hence the article 20, is moved toward the front, so that the label 14 is peeled surely from the supporting strip 13 and is sticked securely to the article 20. In this embodiment, the holder 21 is moved semiautomatically; the holder is moved manually from the home position to the waiting position by manually operating the setting lever 33, and then the holder is moved from the waiting position via the labeling position to the home position automatically by the agency of the extension spring 31, which improves the accessibility of the labeling apparatus. Furthermore, since the holder 21 is driven only by the extension spring 31 without using any other driving source such as a motor, the labeling apparatus has lightweight and simple construction having less possibility of trouble.

Basically, the labeling apparatus according to the present invention moves the article relative to the label peeled from the supporting strip and issued in the label peeling and issuing section. Accordingly, variation in the position of the label on the article is reduced and the label is sticked accurately and surely to the article. As the article is held on the holder which is moved only in a fixed direction along the guide paths and the reverse movement preventing plates, erroneous labeling operation is avoided and the articule is moved surely for accurate labeling operation. Since the article is moved toward the front raising the label upward, the label is peeled from the supporting strip surely and is sticked securely to the article. The holder is moved from the waiting position via the labeling position to the home position by the agency of the energy stored in the extension spring to improve the accessibility of the labeling apparatus. Employment of the extension spring as means to move the holder enables the labeling apparatus to be formed in a simple and lightweight construction. Furthermore, the depressing members of the setting lever apply force properly to the lower pins attached to the holder for the linear movtion of the lower pins along the guide grooves when the setting lever is turned to move the holder from the home position to the waiting position, so that the holder is moved smoothly.

What is claimed is:

1. A labeling apparatus comprising: a label peeling and issuing device for peeling and issuing a label printed with information by a label printer from the supporting sheet; a shiftable holder for holding an article to which the label is to be sticked, disposed near the label peeling and issuing device; holder guiding devices for guiding the holder from a home position where the holder is located apart from the label peeling and issuing device for receiving an article therein via a waiting position obliquely below the label peeling and issuing device to a labeling position where the label issued by the label peeling and issuing device is sticked to the article held on the holder; and reverse movement preventing devices for restricting the movement of the holder so that the holder is moved only in one direction along the guide paths from the home position via the waiting position and the labeling position back to the home position.

2. A labeling apparatus according to claim 1, wherein the holder is disposed between opposite side plates, and the guide paths and the reverse movement preventing devices are provided in the side plates, respectively.

3. A labeling apparatus according to claim 1, wherein an upper pin and a lower pin are provided on each side wall of the holder so as to project outward therefrom, and the upper and lower pins are guided along the guide paths, respectively.

4. A labeling apparatus according to claim 1, wherein a guide path is formed by a linear guide groove and a substantially triangular guide path.

5. A labeling apparatus according to claim 4, wherein a substantially triangular path having a path declining downward from the home position to the waiting position, a path inclining upward from the waiting position to the lableing position and a path extending from the lableing position to the home position is formed in the inner surface of each side plate.

6. A labeling apparatus according to claim 4, wherein the holder guiding device comprises a recess formed in the side plate and a reverse movement preventing plate pivotally disposed in the recess and urged in one direction.

7. A labeling apparatus comprising: a label peeling and issuing device for peeling and issuing a label printed with information by a label printer from the supporting sheet; a shiftable holder for holding an article to which the label is to be sticked, disposed near the label peeling and issuing device; an upper pin and a lower pin provided on each side wall of the holder; holder guiding devices each for guiding the upper pin so that the holder is moved from a home position away from the label peeling and issuing device, where an article is set in the holder, via a waiting position below the label peeling and issuing device to a labeling position where the label issued by the label peeling and issuing device is sticked to the article; and reverse movement preventing devices provided in the holder guiding devices, respectively, each for guiding the upper pin so that the holder is moved from the home position via the waiting position and the labeling position back to the home position only in one direction; and guiding means having striaght guide paths for linearly guiding the lower pins toward the label peeling and issuing device.

8. A labeling apparatus according to claim 1, wherein the label peeling and issuing device has a peeling plate for sharply bending a supporting strip carrying rectangular lables in a successive arrangement, disposed after the printing head of the associated label printer.

9. A labeling apparatus according to claim 8, wherein the label is issured with the underside thereof coated with an adhesive facing down, and a label pressing roller is disposed above the label issured by the label peeling and issuing device.

10. A labeling apparatus according to claim 8, wherein the rear end of the label issured by the label peeling and issuing device is still sticking to the supporting strip when the upper end of the article held on the holder is brought into contact with the front end of the label.

11. A labeling apparatus according to claim 1, wherein the holder guiding paths are formed so as to guide the holder so that the article held on the holder is moved toward the label still sticking at the rear end thereof to the supporting strip, and then the article is moved toward the front pushing up the label.

12. A labeling apparatus according to claim 11, wherein the holder is formed in the shape of a box having an opening for receiving an article therethrough into the holder.

13. A labeling apparatus comprising: a label peeling and issuing device for peeling and issuing a label printed with information by a label printer from the supporting sheet; a shiftable holder for holding an article to which the label is to be sticked, disposed near the label peeling and issuing device; holder guiding paths for guiding the holder from a home position where the holder is located apart from the label peeling and issuing device for receiving an article therein, via a waiting position obliquely below the label peeling and issuing device to a labeling position where the label issured by the label peeling and issuing device is sticked to the article held on the holder; reverse movement preventing devices each provided in the holder guiding path to allow the holder to be moved from the home position via the waiting position and the labeling position back to the home position only in one direction; an extension spring connected to the holder so as to contract to the minimum working length thereof when the holder is located at the home position and to be extended to the maximum working length thereof when the holder is moved manually to the waiting position to store energy for automatically moving the holder from the waiting position via the labeling position to the home position.

14. A labeling apparatus comprising: a label peeling and issuing device for peeling and issuing a label printed with information by a label printer from the supporting sheet; a shiftable holder for holding an article to which the label is to be sticked, disposed near the label peeling and issuing device; an upper pin and a lower pin provided on each side wall of the holder; holder guiding devices each for guiding the upper pin so that the holder is moved from a home position away from the label peeling and issuing device, where an article is set in the holder, via a waiting position below the label peeling and issuing device to a labeling position where the label issued by the label peeling and and issuing device is sticked to the article; reverse movement preventing devices provided in the holder guiding devices, respectively, each for guiding the upper pin so that the holder is moved from the home position via the waiting position and the labeling position back to the home position only in one direction; guiding means having straight guide paths for linearly guiding the lower pins toward the label peeling and issuing device; and a setting lever which is turned to move the holder from the home position to the waiting position.

15. A labeling apparatus comprising: a label peeling and issuing device for peeling and issuing a label printed with information by a label printer from the supporting sheet; a shiftable holder for holding an article to which the label is to be sticked, disposed near the label peeling and issuing device; an upper pin and a lower pin provided on each side wall of the holder; holder guiding devices each for guiding the upper pin so that the holder is moved from a home position away from the label peeling and issuing device, where an article is det in the holder, via a waiting position below the label peeling and issuing device to a labeling position where the label issured by the label peeling and issuing device is sticked to the article; reverse movement preventing devices provided in the holder guiding devices, respectively, each for guiding the upper pin so that the holder is moved from the home position via the waiting position and the labeling position back to the home position only in one direction; guiding means having straight guide paths for linearly guiding the lower pins toward the label peeling and issuing device; and depressing members provided on a setting lever which is turned to move the holder from the home position to the waiting position, so as to depress the lower pins along the straight guide paths.

* * * * *